US006429757B1

(12) United States Patent
Karlsson et al.

(10) Patent No.: US 6,429,757 B1
(45) Date of Patent: Aug. 6, 2002

(54) COUPLING ARRANGEMENT FOR A STRIPLINE NETWORK

(75) Inventors: Ingmar Karlsson, Kållered; Camilla Johansson, Kareby; Yvonne Jensen, Mölndal, all of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/468,844

(22) Filed: Dec. 22, 1999

(30) Foreign Application Priority Data

Dec. 29, 1998 (SE) ..... 9804582

(51) Int. Cl.[7] ..... H01P 3/08
(52) U.S. Cl. ..... 333/246; 333/116
(58) Field of Search ..... 333/246, 116; 343/700 MS

(56) References Cited

U.S. PATENT DOCUMENTS 4,486,758 A * 12/1984 de Ronde ..... 300/700 MS
5,373,187 A * 12/1994 Sugino et al. ..... 257/664
5,532,643 A 7/1996 Kuffner et al.
5,652,595 A 7/1997 Ahrens et al.
5,701,128 A 12/1997 Okada et al.
5,729,237 A 3/1998 Webb

* cited by examiner

*Primary Examiner*—Robert Pascal
*Assistant Examiner*—Kimberly Glenn
(74) *Attorney, Agent, or Firm*—Nixon & Vanderhye. P.C.

(57) ABSTRACT

Coupling arrangement (100, 200) for a stripline network, which comprises a first (160) and a second (110) ground plane, which ground planes are arranged essentially parallel to one another, extend in a common main direction, and each have at least one aperture (170, 120), a stripline conductor (130) arranged between the first (160) and the second (110) ground plane, a first dielectric layer (190) located between the stripline conductor (130) and the first ground plane (160), and a second dielectric layer (180) located between the stripline conductor (130) and the second ground plane (110). The stripline conductor has a first main surface (150) facing towards the first ground plane and a second main surface (140) facing towards the second ground plane. In connection with the apertures (170, 120) of the ground planes, the distance ($d_1$, $d_1'$) from the aperture to the most closely located main surface (150, 140) of the stripline conductor (130) is considerably exceeded by the distance ($d_2$, $d_2'$) from said main surface to the other ground plane (110, 160). The distances ($d_1$, $d_1'$) from the apertures (170, 120) of each respective ground plane (160, 110) to the most closely located main surface (150, 140) of the stripline conductor (130) are preferably essentially equal.

21 Claims, 2 Drawing Sheets

COUPLING ARRANGEMENT FOR A STRIPLINE NETWORK

TECHNICAL FIELD

The present invention relates to a coupling arrangement for a stripline network. The arrangement is primarily intended for application in microwave antennas, but can also be used in other microwave applications.

BACKGROUND

Stripline technology is commonly used in the microwave range. A common stripline arrangement comprises two ground planes parallel to one another, and a conductor located between the ground planes and parallel to them. Dielectric material is arranged on both sides of the conductor.

A common application of stripline arrangements is to use them as power distribution networks and transmission lines. In some applications, it is necessary to couple together stripline arrangements which lie in different layers in multilayer structures, or for the stripline arrangement to be coupled to other types of transmission lines or antenna elements which are located above or below the ground plane of the stripline arrangement.

A known technique for effecting coupling between stripline arrangements in different layers is to electrically connect the conductors in the two arrangements by means of pins or plated via-holes. A shortcoming of this technique is that it requires great manufacturing precision and increases the weight of the arrangement, and that, as a result of the inevitable discontinuities, undesirable electromagnetic modes arise, which in turn gives rise to a requirement for separate arrangements for mode suppression.

Another way of effecting coupling between a stripline arrangement and another structure in another layer is to arrange a slot or another type of aperture in the intermediate ground plane. In order to achieve good coupling between the stripline conductor and the slot, some form of asymmetry is required in the stripline arrangement.

An example of such asymmetry is described in U.S. Pat. No. 5,532,643, which describes a stripline arrangement for coupling between the stripline conductor and a slot in one ground plane of the arrangement. The arrangement comprises plates made of a first dielectric material on one side of the stripline conductor, and plates made of a second dielectric material on the other side of the stripline conductor, the first and the second dielectric materials having different dielectric constants. This arrangement gives rise to the asymmetry which is required in order for the conductor to couple to the slot and also to the conductor in the next stripline arrangement.

A shortcoming of this arrangement is that, since it requires different dielectric materials on both sides of the stripline conductor, air cannot be used throughout as the dielectric material in the arrangement. This is a disadvantage because most dielectric materials other than air result in high losses at high frequencies, which makes the arrangement difficult to use within that part of the microwave range. Furthermore, the majority of dielectric materials with good properties at high frequencies are expensive, which increases the cost of the arrangement.

SUMMARY OF THE INVENTION

The present invention provides an arrangement for coupling between apertures in the ground planes in a stripline network, which suppresses undesirable modes and provides a good degree of coupling. For the suppression of undesirable modes, the arrangement is free from discontinuities, and in order to achieve good coupling, the arrangement exhibits electrical asymmetry.

The coupling arrangement comprises a first and a second ground plane arranged essentially parallel to one another and extending in a common main direction and each having at least one aperture. A stripline conductor is arranged between the first and the second ground plane. A second dielectric layer is located between the stripline conductor and the second ground plane.

The stripline conductor includes a first main surface facing towards the first ground plane, and a second main surface towards the second ground plane. In connection to the apertures of the ground planes, the distance from the aperture to the most closely located main surface of the stripline conductor is considerably exceeded by the distance from the main surface to the other ground plane.

This relationship between the distances from each respective aperture to the other ground plane and to the stripline conductor means provides electrical asymmetry, which means that the desired coupling between the apertures and the stripline conductor is obtained.

Undesired modes are suppressed by virtue of the fact that the distance from each respective ground plane to the most closely located main surface of the stripline conductor is essentially constant within the arrangement. In other words, it is essentially free from discontinuities, which means that the arrangement is also mechanically simple. Moreover, the distances to the most closely located main surface of the stripline conductor from each respective ground plane, and thus from the aperture of each respective ground plane, are preferably essentially equal.

As the invention makes it possible to construct an arrangement with mechanical symmetry, the same dielectric material can be used on both sides of the stripline conductor. In a preferred embodiment, the dielectric material used is air, which eliminates dielectric losses.

Further advantageous embodiments are indicated in the appended subclaims.

BRIEF DESCRIPTION OF THE DRAWINGS

The invention will be described in greater detail below by means of examples of embodiments, and with reference to the appended drawings, in which.

DETAILED DESCRIPTION

Figure 1:
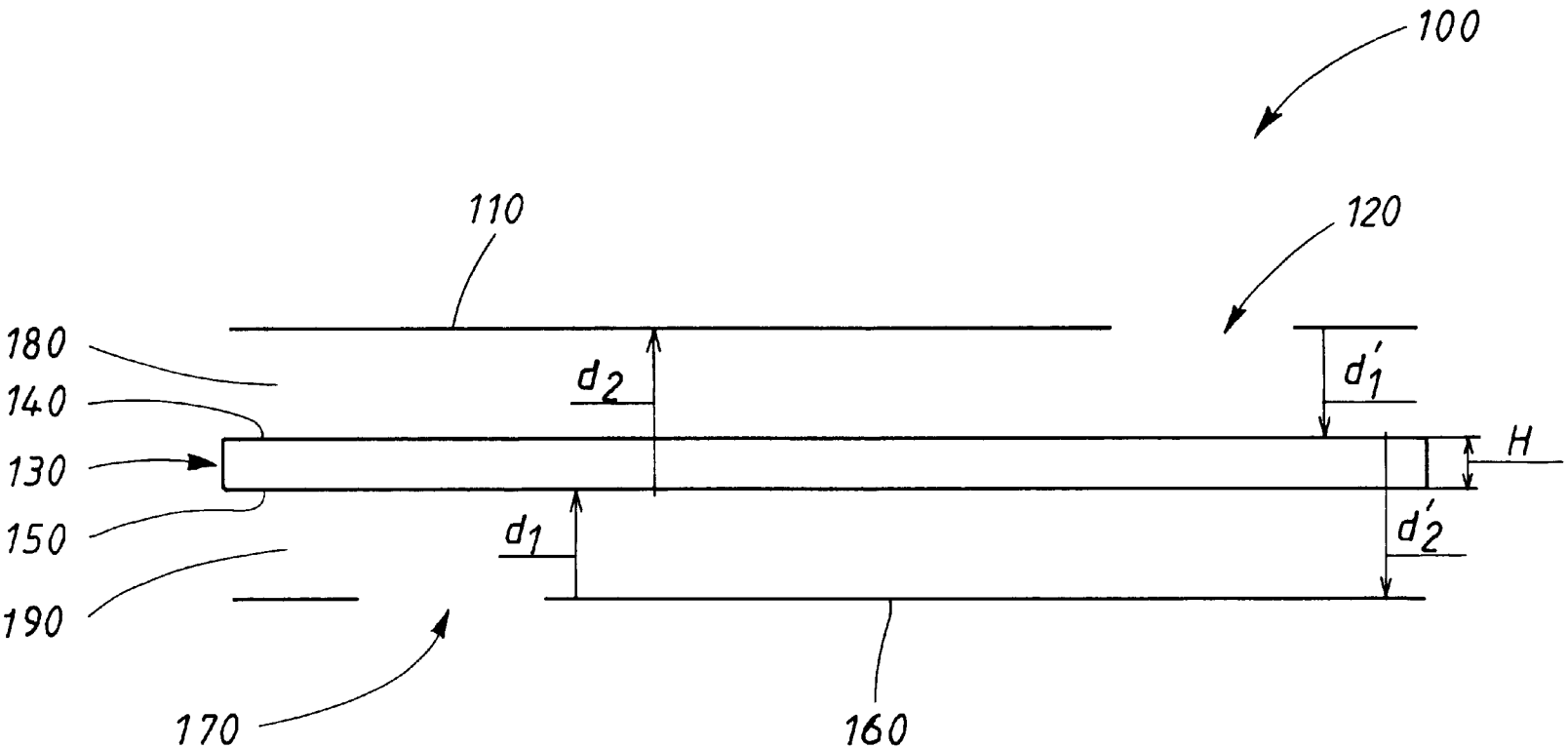
FIG. 1 shows a basic cross section of an arrangement according to the invention.

FIG. 1 shows a cross section from the side of an arrangement 100 according to a preferred embodiment of the invention. The arrangement 100 comprises a first ground plane 160 and a second ground plane 110, which extend parallel to one another in a common main direction and each have an aperture 170, 120.

The arrangement 100 also comprises a stripline conductor 130 which has a first main surface 150 facing towards the first ground plane 160, and a second main surface 140 facing towards the second ground plane 110. The stripline conductor 130 is arranged between the two ground planes, essentially parallel to them. There is a dielectric material 180, 190 on both sides of the stripline conductor. This dielectric material is not shown but is simply indicated by FIG. 1 showing the interspaces on both sides of the stripline conductor 130 in which dielectric material can be arranged.

One object of the arrangement 100 is to bring about good electrical coupling between the aperture 170 in the first ground plane 160 and the aperture 120 in the second ground plane 110 via coupling to the stripline conductor 130. Good coupling between the apertures via the stripline conductor will be achieved only if the arrangement 100 is asymmetrical seen from the first ground plane 160 in a direction perpendicular to the stripline conductor 130 and the second ground plane 110.

This desired asymmetry is achieved in the arrangement according to the invention by virtue of the fact that the stripline conductor 130 in the arrangement 100 is given such a thickness H that, in connection to the apertures 170, 120 in the ground planes 160, 110, the distance $d_1$, $d_1'$ from the aperture to the most closely located main surface 150, 140 of the stripline conductor 130 is considerably exceeded by the distance $d_2$, $d_2'$ from said main surface to the other ground plane.

In a preferred embodiment, the desired relationship between the distances $d_1$, $d_2$; $d_1'$, $d_2'$ is achieved by virtue of the fact that the stripline conductor 130 is given a thickness H which is of the same order of size as the distances $d_1$, $d_1'$ from each respective aperture 120, 170 to the most closely located main surface 150, 140 of the stripline conductor 130.

In an alternative embodiment, the desired relationship between the distances $d_1$, $d_2$; $d_1'd_2'$ can be achieved by virtue of the fact that the stripline conductor 130 is given a thickness H which is half the distance $d_1$, $d_1'$ from each respective aperture 120, 170 to the most closely located main surface 150, 140 of the stripline conductor 130.

The desired relationship between the distances $d_1$, $d_2$; $d_1'$, $d_2'$ can of course be achieved in a great many different ways while retaining good functioning. The dimensions of the stripline conductor 130 stated above should be seen only as examples of preferred embodiments which share the feature of being simple to manufacture. In order to provide good functioning however, it is suitable for the stripline conductor 130 to have a thickness H which lies within the range $d/4 \leqq H \leqq 2d$, where d is either of the distances $d_1$, $d_1'$ from each respective aperture 120, 170 to the most closely located main surface 150, 140 of the stripline conductor 130.

In a preferred embodiment in the frequency range of 40 GHz, the distances $d_1$, $d_1'$ from the apertures to the stripline conductor are 0.5 mm, but 1 mm is also a possible dimension. In the embodiments in which the stripline conductor 130 is given a thickness which is of the same order of size as the distances, the thickness of the stripline conductor will in other words be of the order of size of 0.5 mm or 1 mm.

In the embodiments in which the stripline conductor 130 is given a thickness which corresponds to half the distances from the apertures to the stripline conductor, the thickness of the stripline conductor is 0.25 mm or 0.5 mm in the embodiment in the frequency range of 40 GHz.

A further aim of the arrangement according to the invention is that undesirable modes are to be suppressed to the greatest extent possible. Such suppression will be obtained if the arrangement is free from discontinuities, which is achieved according to the invention because the stripline conductor 130 in the arrangement 100 has a constant thickness, i.e., it is essentially a plane, and is located between, and is essentially parallel to, the two ground planes 110, 160, using air as the dielectric.

With the stripline conductor 130 located essentially halfway between the two ground planes, the distances $d_1$, $d_1'$ from the two ground planes 110, 160 to the stripline conductor 130 will be essentially equal. As a result of this, the dielectric materials 180, 190 located on both sides of the stripline conductor 130 can have the same dielectric constant, which in turn makes it possible to use air as the dielectric material on both sides of the stripline conductor, which is advantageous because air has extremely good properties as a dielectric, for example with regard to losses.

If air is used as the dielectric, the stripline conductor 130 is preferably separated from the two ground planes 160, 110 by means of distance pieces located in selected positions along the conductor and made from a material with dielectric losses which are as small as possible. Another alternative is to separate the ground planes and the stripline conductor by locating plates made of a suitable dielectric material between the stripline conductor and the two ground planes, with the plates dimensioned so that they only partly fill the spaces between the conductor and the ground planes. Through-holes are then suitably made in the plates over as large a part of their surface as the desired mechanical stability allows in order thus to combine the mechanical stability provided by the plates with the dielectric properties of air.

Figure 2:
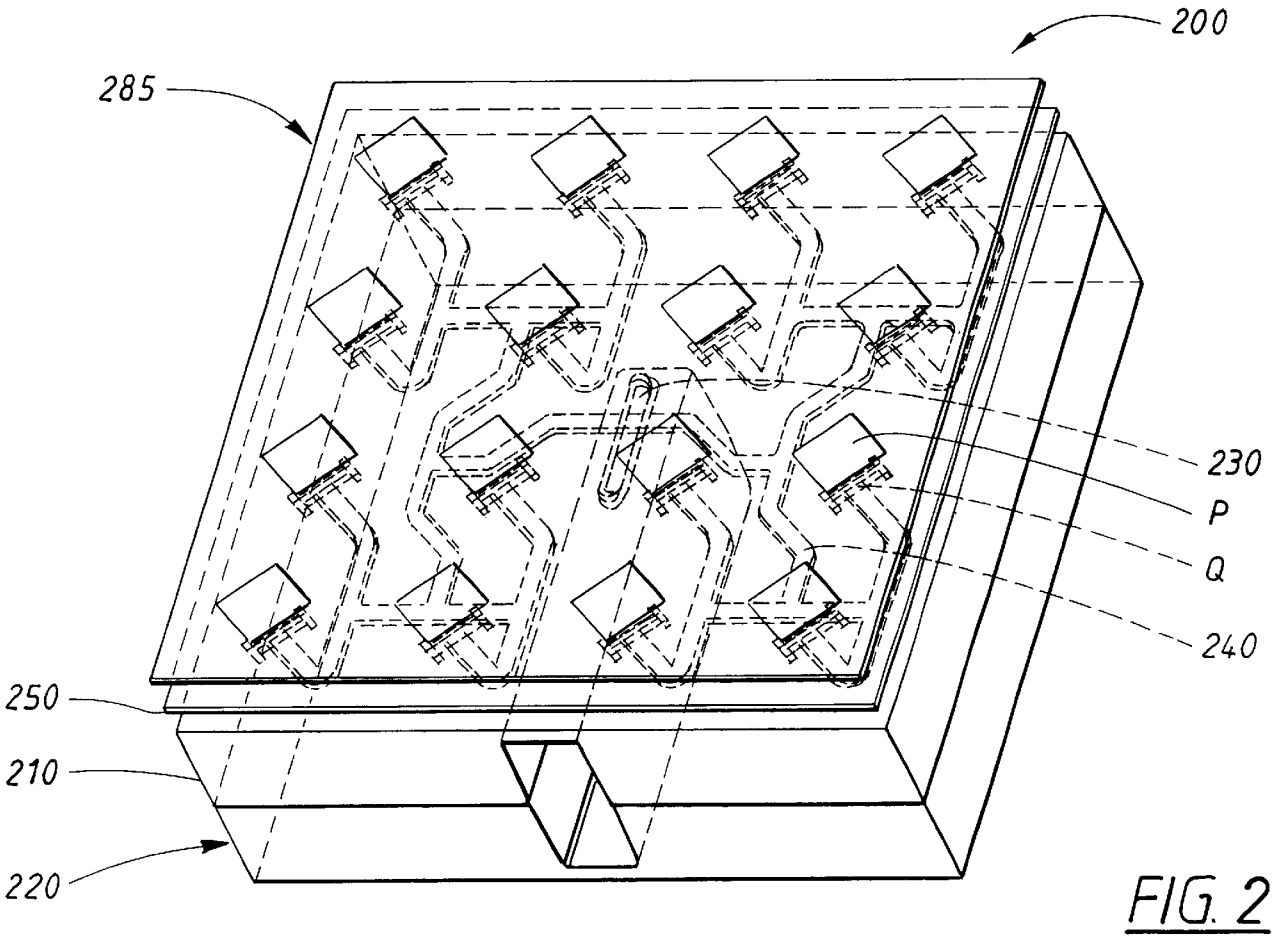
FIG. 2 shows a perspective diagram of an arrangement according to the invention.

FIG. 2 shows a perspective diagram of an arrangement 200 in which the invention is applied. The arrangement 200 is an antenna intended for use in the higher microwave range, roughly 40 GHz. The antenna comprises a first ground plane 210 which consists of a wall in a waveguide structure 220. As indicated in FIG. 2, the waveguide structure is divided along a plane which extends parallel to a stripline conductor 240 in the arrangement. As a result of this division in the centre of the broad side of the waveguide, no current paths are broken, and leakage is counteracted.

There is a slot 230 in the waveguide structure. A stripline conductor 240 is located above the waveguide structure 220 at a predetermined distance from the latter. The stripline conductor 240 is kept electrically separated from the ground plane 210, for example by dielectric distance pieces or plates in the manner described above in connection with FIG. 1. FIG. 2 does not show the means which are used for keeping the conducting parts of the construction 200 electrically separated from one another.

By means of the stripline conductor, power is distributed to a number of points Q in the arrangement. Arranged above the stripline conductor 240, electrically separated from the latter, is a second ground plane 250. In this second ground plane 250, slots are arranged in front of each point Q. The slots are suitably arranged at right angles to that part of the stripline conductor which they are located above, and are intersected at their centre point by the stripline conductor. Other angles between the slots and the conductor are of course also possible.

Arranged above the second ground plane 250 is a number of patches P. Each patch P is located essentially in front of a slot in the second ground plane 250.

The invention therefore makes it possible to construct an antenna which has the asymmetry which is required so as to be capable of coupling from apertures in ground planes to a stripline conductor and vice versa, at the same time as suppression of undesirable modes is achieved by virtue of the fact that the invention makes possible an arrangement which is free from discontinuities. As a result of this, air can be used as the main dielectric material on both sides of the stripline conductor.

The arrangement shown in FIG. 2 is an example of how a coupling arrangement according to the invention can be used to make apertures in one of the ground planes 250 feed an arrangement or structure P outside the coupling arrangement. The arrangement or structure which is fed is of course not limited to patches, as shown in connection with FIG. 2, but can be varied in a great many ways.

The invention is not limited to the embodiments which have been described above but can be varied freely within the scope of the patent claims below.

For example, the invention can in principle be applied in all situations in which it is desired to couple between slots in two ground planes via a stripline conductor. An example of such an application is an antenna arrangement in which one of the apertures of the ground planes is used as a radiation element.

A coupling arrangement according to the invention can also be used for making one of the apertures of the ground planes couple to a conductor. A variant of this embodiment is to make one of the ground planes forming part of the arrangement according to the invention also be a ground plane for a conductor. In another embodiment, as shown in connection with the example in FIG. 2 above, one ground plane in the arrangement according to the invention can constitute a wall in a waveguide.

What is claimed is:

1. A coupling arrangement for a stripline network comprising:

a first and second ground plane arranged essentially parallel to one another and extending in a common main direction, each including at least one aperture, a stripline conductor arranged between the first and the second ground plane and including a first main surface facing towards the first ground plane and a second main surface facing towards the second ground plane, a first dielectric layer located between the stripline conductor and the first ground plane, a second dielectric layer located between the stripline conductor and the second ground plane, wherein a shortest distance from the aperture in one of the first and second ground planes to a closest one of the first and second main surfaces of the stripline conductor is considerably exceeded by a shortest distance from the one of the first and second main surfaces of the stripline conductor to the other of the first and second ground planes.

2. The coupling arrangement according to claim 1, in which the distances from the apertures of each respective ground plane to the most closely located main surface of the stripline conductor are essentially equal.

3. The coupling arrangement according to claim 1, in which the stripline conductor is arranged essentially parallel to the ground planes and has a thickness of the same order of size as the distances from each respective aperture to the most closely located main surface of the stripline conductor.

4. A coupling arrangement according to claim 1, in which the stripline conductor is arranged essentially parallel to the ground planes and has a thickness which is half the distances from each respective aperture to the most closely located surface of the stripline conductor.

5. A coupling arrangement according to claim 1, in which the stripline conductor is arranged essentially parallel to the ground planes and exhibits a thickness which lies within the range $d/4 \leqq H \leqq 2d$, where d is either of the distances from each respective aperture to the most closely located main surface of the stripline conductor.

6. A coupling arrangement according to claim 1, in which one of the apertures of the ground planes is used as a radiation element in an antenna.

7. A coupling arrangement according to claim 1, in which the apertures of the ground planes are used to feed an arrangement outside the coupling arrangement.

8. A coupling arrangement according to claim 1, in which one of the apertures of the ground planes is used to feed a patch outside the coupling arrangement.

9. A coupling arrangement according to claim 1, in which at least one of the apertures of the ground planes couples to a conductor outside the coupling arrangement.

10. A coupling arrangement according to claim 9, in which at least one of the ground planes also is a ground plane for the conductor.

11. A coupling arrangement according to claim 1, in which at least one of the ground planes constitutes a wall in a waveguide.

12. A coupling arrangement for a stripline network comprising:

a first and second ground plane arranged essentially parallel to one another and extending in a common main direction, each including at least one aperture, a stripline conductor arranged between the first and the second ground plane and including a first main surface facing towards the first ground plane and a second main surface facing towards the second ground plane, a first dielectric layer located between the stripline conductor and the first ground plane, a second dielectric layer located between the stripline conductor and the second ground plane, wherein a thickness of the stripline conductor (H) is in the range of $d/4 \leqq H \leqq 2d$, where d is one of the distances from one of the apertures to a closest main surface of the stripline conductor.

13. The coupling arrangement according to claim 12, in which the distances from the apertures of each respective ground plane to the most closely located main surface of the stripline conductor are essentially equal.

14. The coupling arrangement according to claim 12, in which the stripline conductor is arranged essentially parallel to the ground planes and has a thickness of the same order of size as the distances from each respective aperture to the most closely located main surface of the stripline conductor.

15. A coupling arrangement according to claim 12, in which the stripline conductor is arranged essentially parallel to the ground planes and has a thickness which is half the distances from each respective aperture to the most closely located surface of the stripline conductor.

16. A coupling arrangement according to claim 12, in which one of the apertures of the ground planes is used as a radiation element in an antenna.

17. A coupling arrangement according to claim 12, in which the apertures of the ground planes are used to feed an arrangement outside the coupling arrangement.

18. A coupling arrangement according to claim 12, in which one of the apertures of the ground planes is used to feed a patch outside the coupling arrangement.

19. A coupling arrangement according to claim 12, in which at least one of the apertures of the ground planes couples to a conductor.

20. A coupling arrangement according to claim 19, in which at least one of the ground planes also is a ground plane for the conductor.

21. A coupling arrangement according to claim 12, in which at least one of the ground planes constitutes a wall in a waveguide.

* * * * *